US006176630B1

(12) United States Patent
Miller et al.

(10) Patent No.: US 6,176,630 B1
(45) Date of Patent: Jan. 23, 2001

(54) UNIVERSAL SENSOR INDEX APPARATUS

(75) Inventors: Dean O. Miller, Littleton; Mathew D. Romero, Denver; Matthew D. Woodbury, Westminster, all of CO (US)

(73) Assignee: Axiohm Transaction Solutions, Inc., Ithaca, NY (US)

( * ) Notice: Under 35 U.S.C. 154(b), the term of this patent shall be extended for 0 days.

(21) Appl. No.: 09/399,668

(22) Filed: Sep. 21, 1999

(51) Int. Cl.[7] ..... B41J 29/19
(52) U.S. Cl. ..... 400/711; 400/708
(58) Field of Search ..... 400/711, 708, 400/707.1, 706, 705, 703

(56) References Cited

U.S. PATENT DOCUMENTS 4,339,208 * 7/1982 Biedermann ..... 400/711
4,590,859 * 5/1986 Pou et al. ..... 101/484
4,748,454 * 5/1988 Ikeda et al. ..... 400/711
5,713,678 * 2/1998 Smith et al. ..... 400/703
5,915,865 * 6/1999 Wade ..... 400/707.1

FOREIGN PATENT DOCUMENTS

404039045 * 2/1992 (JP) ..... 400/711

* cited by examiner

*Primary Examiner*—John S. Hilten
*Assistant Examiner*—Anthony H. Nguyen
(74) *Attorney, Agent, or Firm*—Salzman & Levy

(57) ABSTRACT

A universal index sensing apparatus. The index sensing apparatus can mount within the media cavities of different printers and can easily adjust for different brands and sizes of media moving therethrough.

12 Claims, 2 Drawing Sheets

UNIVERSAL SENSOR INDEX APPARATUS

FIELD OF THE INVENTION

The invention pertains to printing devices and, more particularly, to a printer having a universally adjustable sensor index apparatus.

BACKGROUND OF THE INVENTION

Most barcode or receipt printers have an index sensor feature for allowing the printer to register the print on each printed label or receipt. The index sensor utilizes a periodic, pre-printed, black band disposed on the back side of a roll of supply media, which is dispensed as a moving web continuum. Periodic holes cut into the media, or the gaps between the labels, can also be used as a registration means.

A typical index sensing apparatus consists of a light emitting diode (LED) and a light detector. The index sensing apparatus is disposed opposite the back side surface the moving media web. The LED directs light at the back side of the media, which reflects the light back to the light detector. As a black band moves past the LED, the emitted light from the LED fails to be reflected from the black band. It is this absence of light that is sensed by the detector. Every time a black band is sensed, the index sensing apparatus provides a registration signal. Holes in the media web have the same effect as black bands, since light passes through the holes and fails to be reflected.

Most printers have fixed index sensing positions, from side to side, within the media cavity. One of the problems associated with these index sensing apparatuses are their lack of uniformity of mounting. The precise position of the LED and the light detector, in a given relationship with respect to the media, often has to change. Changing the media size or the media brand necessitates a repositioning of the index sensing apparatus. This is not possible with printers that have a fixed index sensing position.

The present invention seeks to provide a universal index sensing apparatus that can easily be adjusted for different brands of media and changes in the media size. The universal index sensing apparatus can be molded to fit mounting configuration within the media cavities of different printers.

SUMMARY OF THE INVENTION

In accordance with the present invention, there is provided a universal index sensing apparatus. The index sensing apparatus can mount within the media cavities of different printers, and can easily adjust for different brands and sizes of media. The universal index sensing apparatus comprises a molded sleeve having a multiplicity of mounting posts for an LED and light sensing module. The module is placed over an appropriate post. The sleeve is then snapped into the frame of the printer. The sleeve can be molded to be snap-fitted into different media cavities of various models of printers. Graphics are printed on the sleeve or molded into the sleeve, detailing the standard sensor module position. Should the media brand or media size change, the sleeve can be removed from the printer, the index sensing module readjusted to a new post position, and the sleeve snap-fitted back into the media cavity.

It is an object of this invention to provide an improved index media sensing apparatus for printers.

It is another object of the invention to provide a universal index media sensing apparatus that can be used to change the sensing position of the apparatus easily to fit changes in the brand and size of media.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Generally speaking, the invention features a universal index sensing apparatus. The index sensing apparatus can mount within the media cavities of different printers, and can easily adjust for different brands and sizes of media.

Figure 1:
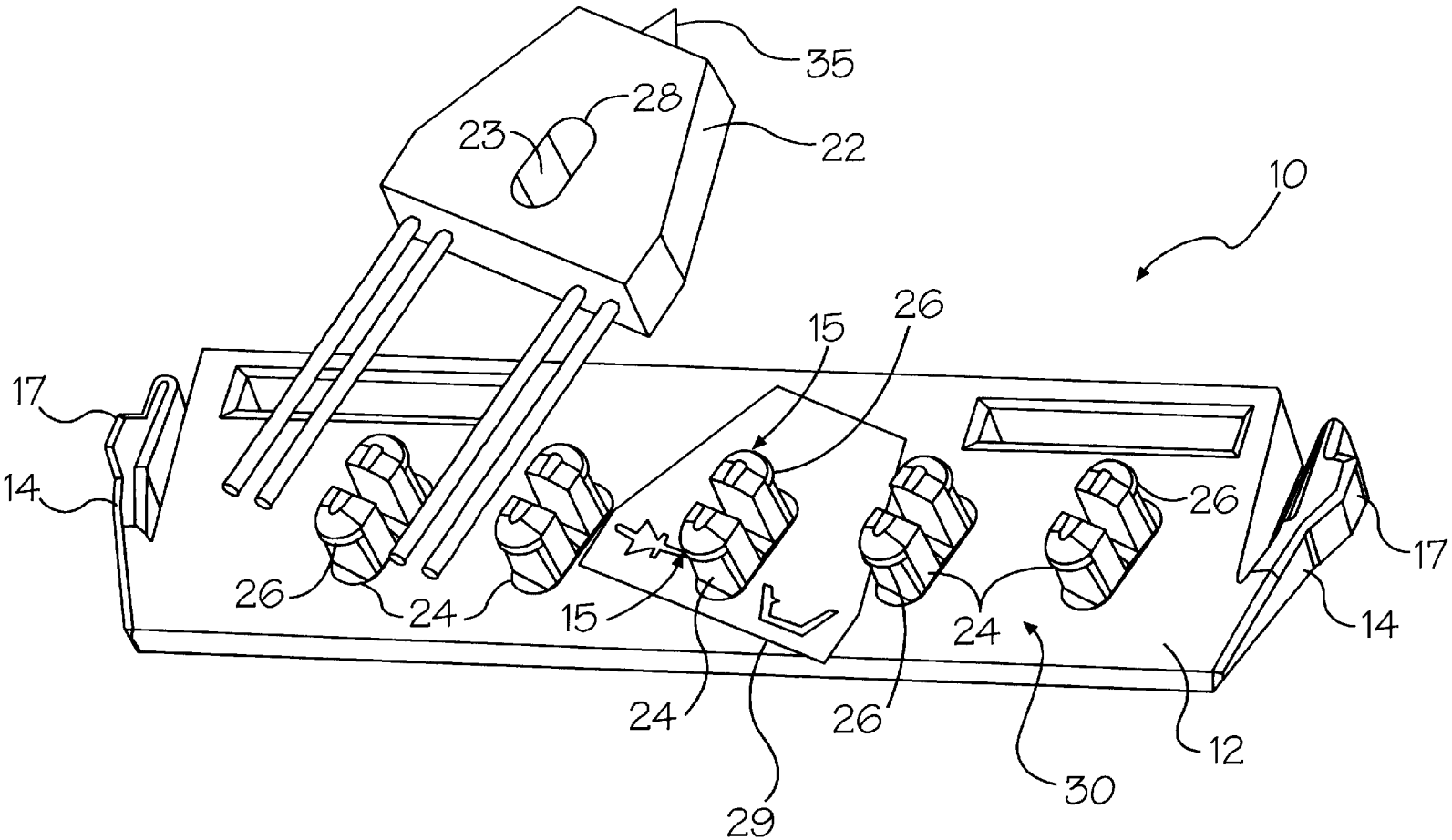
FIG. 1 illustrates an exploded, perspective view of the molded, index sensing sleeve and module of this invention.

Now referring to FIG. 1, the universal index sensing apparatus 10 of this invention is shown. The index sensing apparatus 10 comprises a molded sleeve 12 having flexible, side fasteners 14 molded on each distal end. The sleeve 12 can be fabricated of moldable plastics such as styrene, polypropylene, ABS cycolac, etc. The sleeve 12 can be molded to fit the different sized cavities of most printers.

Figure 2:
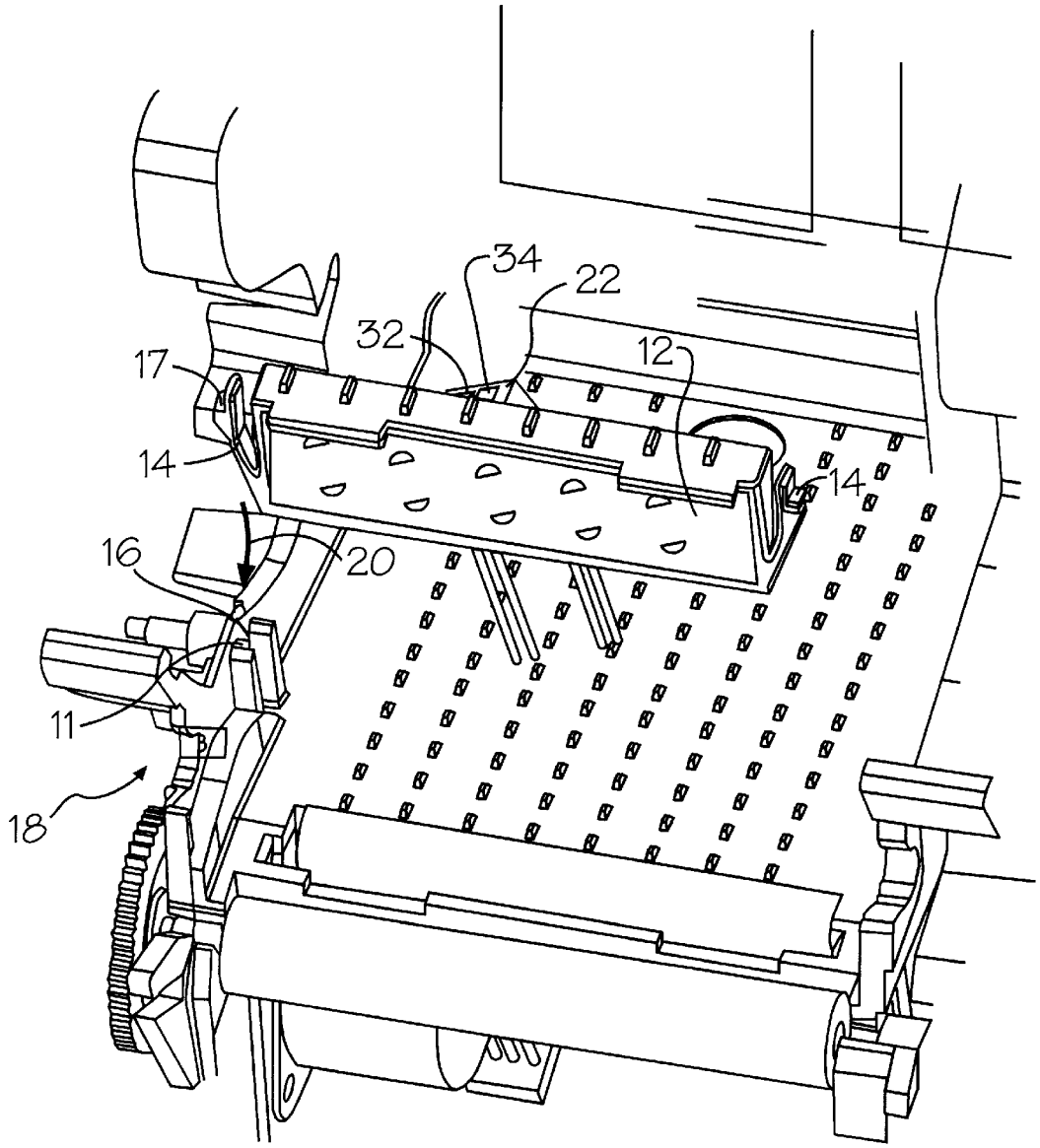
FIG. 2 depicts an in situ, perspective view of the index sensing sleeve with positioned module being mounted into the media cavity of a typical printer.

Referring to FIG. 2, the sleeve 12 is shown being snap-fitted into a typical printer 18. The flexible, side fasteners 14 can be snap-fitted (arrow 20) into side brackets 16. The brackets 16 are respectively disposed on the right and left side of the printer cavity, although only a single, left side bracket 16 is shown in this FIGURE. The abutment 17 of each flexible fastener 14, snaps into a recess (not shown) in the side wall frame 11 of each bracket 16, thus anchoring the sleeve 12 to the printer frame.

Referring again to FIG. 1, the index sensing module 22, having a recess 23, is snap-fitted over one of the multiplicity of pairs of spaced-apart posts 24, which can be squeezed inwardly (arrows 15). Each pair of posts 24 flexibly fits within the recess 23 of module 22. The lip 26 of each pair of posts 24 slides over the rim 28 of the recess 23, thus anchoring the module 22 in place.

The index sensing module 22 can be positioned upon a graphically directed position 29 for any one of a number of printer models and configurations. The position 29 can be molded or printed upon the post-mounting surface 30.

Each index sensing module 22 comprises a light emitting LED 32 and a photo-sensing or light detecting element 34 mounted adjacent thereto, as seen in FIG. 2. The LED 32 and photo detector 34 are positioned to provide the proper reflective path for index sensing, as shown by the phantom lines 35 in FIG. 1. The photo detector 34 provides a signal in response to detection of a registration mark or indicator disposed upon the media web as it moves relative to the index sensing module 22.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An adjustable index sensing apparatus that is mountable about a media web cavity of a printer, comprising:

an index sensing module having a light emitting element and a light detecting element adjacent thereto, said light emitting element providing light for reflection off of a surface of a media web, said reflection of said light being detected by said light detecting element, said index sensing module for providing a signal in response to detecting a registration indicator disposed upon said surface of said media web, which is moving relative thereto; and a sleeve having a mounting surface and a multiplicity of mounting fixtures disposed upon said mounting surface for receiving said index sensing module for providing registration of a media web moving within a media web cavity of a printer, said sleeve having fastener means for mounting said sleeve about said media web cavity of said printer, said index sensing module being mountable upon one of said multiplicity of mounting fixtures disposed upon said mounting surface of said sleeve, said mounting fixtures providing means by which said index sensing module can be fixedly mounted in different locations about said media web cavity.

2. The adjustable index sensing apparatus in accordance with claim 1, wherein said index sensing module has means defining a recess, and wherein said mounting fixtures of said sleeve comprise posts that are received in said recess of said index sensing module.

3. The adjustable index sensing apparatus in accordance with claim 1, wherein said fastener means comprises flexible, snap-acting arms that snap into said printer about said media web cavity.

4. The adjustable index sensing apparatus in accordance with claim 2, wherein said posts are flexibly movable, and snap fit into said recess of said index sensing module.

5. The adjustable index sensing apparatus in accordance with claim 1, wherein said sleeve comprises molded plastic.

6. The adjustable index sensing apparatus in accordance with claim 1, wherein said sleeve is molded to fit a particular printer.

7. An adjustable index sensing apparatus that can be mounted about a media web cavity of a printer, comprising:

an index sensing module having a light emitting element and a light detecting element adjacent thereto, said light emitting element providing light for reflection off of a surface of a media web having a registration indicator disposed upon said surface and which is moving relative to said index sensing module, said reflection of said light being detected by said light detecting element, said index sensing module for providing a signal in response to detecting said registration indicator disposed upon said media web that is moving relative thereto; and a sleeve having a mounting surface and a multiplicity of mounting posts spaced-apart upon said mounting surface for receiving said index sensing module for providing registration of a media web moving relative to said index sensing module, said sleeve having fastener means for mounting said sleeve about a media web cavity of a printer, said index sensing module being mountable upon one of the multiplicity of mounting posts disposed upon said mounting surface of said sleeve, whereby said index sensing module can be fixedly mounted in different locations about said media web cavity.

8. The adjustable index sensing apparatus in accordance with claim 7, wherein said index sensing module has means defining a recess, and wherein a pair of said mounting posts of said sleeve are received in said recess of said index sensing module.

9. The adjustable index sensing apparatus in accordance with claim 7, wherein said fastener means comprises flexible, snap-acting arms that snap into said printer about said media web cavity.

10. The adjustable index sensing apparatus in accordance with claim 8, wherein said posts are flexibly movable, and snap fit into said recess of said index sensing module.

11. The adjustable index sensing apparatus in accordance with claim 7, wherein said sleeve comprises molded plastic.

12. The adjustable index sensing apparatus in accordance with claim 7, wherein said sleeve is molded to fit a particular printer.

* * * * *